340-870.13

SR

XR 3,961,317 X7043Y X7025C X7003N X7049E X7004D X7017N X7020T

United Sta

De Brem et al.

[11] 3,961,317

[45] June 1, 1976

[54] SYSTEM FOR REMOTE READING OF INDICATING DEVICES SUCH AS METERS AND THE LIKE

[75] Inventors: Francois Regis Marcetteau De Brem, Paris; Maurice Denis Waroux, Deuil-la-Barre, both of France

[73] Assignee: Gaz de France, Paris, France

[22] Filed: May 3, 1973

[21] Appl. No.: 357,067

[30] Foreign Application Priority Data

May 8, 1972 France ..... 72.16391

[52] U.S. Cl. ..... 340/188 R; 340/183; 340/204; 340/177 R; 340/409

[51] Int. Cl.[2] ..... G08C 15/06

[58] Field of Search ..... 340/213 Q, 413, 204, 340/183, 188 R

[56] References Cited

UNITED STATES PATENTS

| | | | |
|---|---|---|---|
| 3,039,687 | 6/1962 | Chope | 340/213 Q |
| 3,047,837 | 7/1962 | Fieser | 340/188 R |
| 3,145,374 | 8/1964 | Benner | 340/183 |
| 3,219,991 | 11/1965 | Fredtas | 340/213 Q |
| 3,495,074 | 2/1970 | Jacques | 340/413 |
| 3,697,970 | 10/1972 | Jaxheimer | 340/204 |

*Primary Examiner*—Thomas B. Habecker

[57] ABSTRACT

A system for remote reading of indicating devices such as meters and the like, which devices are comprised of a plurality of switch contacts and associated resistance elements. The reading systems senses the closing of one or more of a group of device contacts and does so using only a single pair of sensing lines for each group. Additionally, means is provided for sequencially selecting pairs of lines from a plurality of said pairs of lines, each pair associated with a single group among several assemblies of many groups. The selected pair of sensing lines is routed to an analog-to-digital converter, the output of which is sent to a computing device for processing the data received on the pair of sensing lines.

13 Claims, 14 Drawing Figures

SYSTEM FOR REMOTE READING OF INDICATING DEVICES SUCH AND METERS AND THE LIKE

The present device is designed for a remote reading of a great number of detecting and/or indicating devices, for example gas meters detecting the passage of a certain number of cubic meters of gas, thereby avoiding the periodical inspection by an employee coming in front of each apparatus and while allowing detection of an eventual trouble or a possible fraud. As an example, the detecting apparatuses may be water, gas or electric meters; they can also be measuring apparatus such as voltmeters, flowmeters, amperemeters, manometers, leak-finders, fault-to-ground detectors, etc . . .

In the particular case where power meters are concerned, they may be provided — on one of the wheels of the adding device — with a device setting on or off a switch during one turn. A quantum of power, in such a case, corresponds to one turn of the wheel. The device according to the invention provides for scanning the on or off state of said switch at a frequency higher than the maximal speed of rotation of the wheel to make sure not to omit metering a quantum of power, the device also provides for making a remote recopy of the state of the switch. Also it is desired to reduce at a maximum the number of the remote transmission wires of the information supplied to the collecting and scanning system. The present invention solves this problem in a particularly appropriate manner.

There are already known devices performing such a remote reading. For example, the French Pat. No. 1,601,602 belonging to the Compagnie des Computeurs Schlumberger, describes a processus for the remote reading of detecting components of various variables which includes a cascade scanning performed step by step along a main line. The present invention uses a rectangular matrix where the combination of two groups of lines allows the examination of several groups of a predetermined number of meters whose mobile contacts set a resistor on or off circuit.

According to the invention, apparatus for detecting, transmitting and storing a total number of events that have occurred in a set of indicating devices are distributed in a number M of assemblies of N groups comprising at least one apparatus, whereby the total number of groups of apparatuses which can be grouped and whose informations are remote transmitted is at the utmost equal to M N, the apparatuses of each group are respectively associated, on one hand to at least one impedance per group, and, on the other hand, to contacts having at least one on state and one off state in a number equal to the number of impedances, each group of apparatuses being successively connected as input to an analog to digital converter through a rectifying device and an electric current supply source, in such a way that said current is transformed in a group of numerical information elements representing the state of the contacts of each group of apparatuses, outputs of the analog-to digital converter being connected to a computing device to process informations received from the converter.

Various other characteristics of the invention are shown in the following detailed description.

Embodiments of the invention are shown by way of non-restricted examples in the accompanying drawings, in which:

FIGS. 1–4 show various examples of groups of detecting apparatuses which can be assembled according to the invention;

FIG. 5 diagrammatically shows a remote reading device according to the invention;

Figure 8:
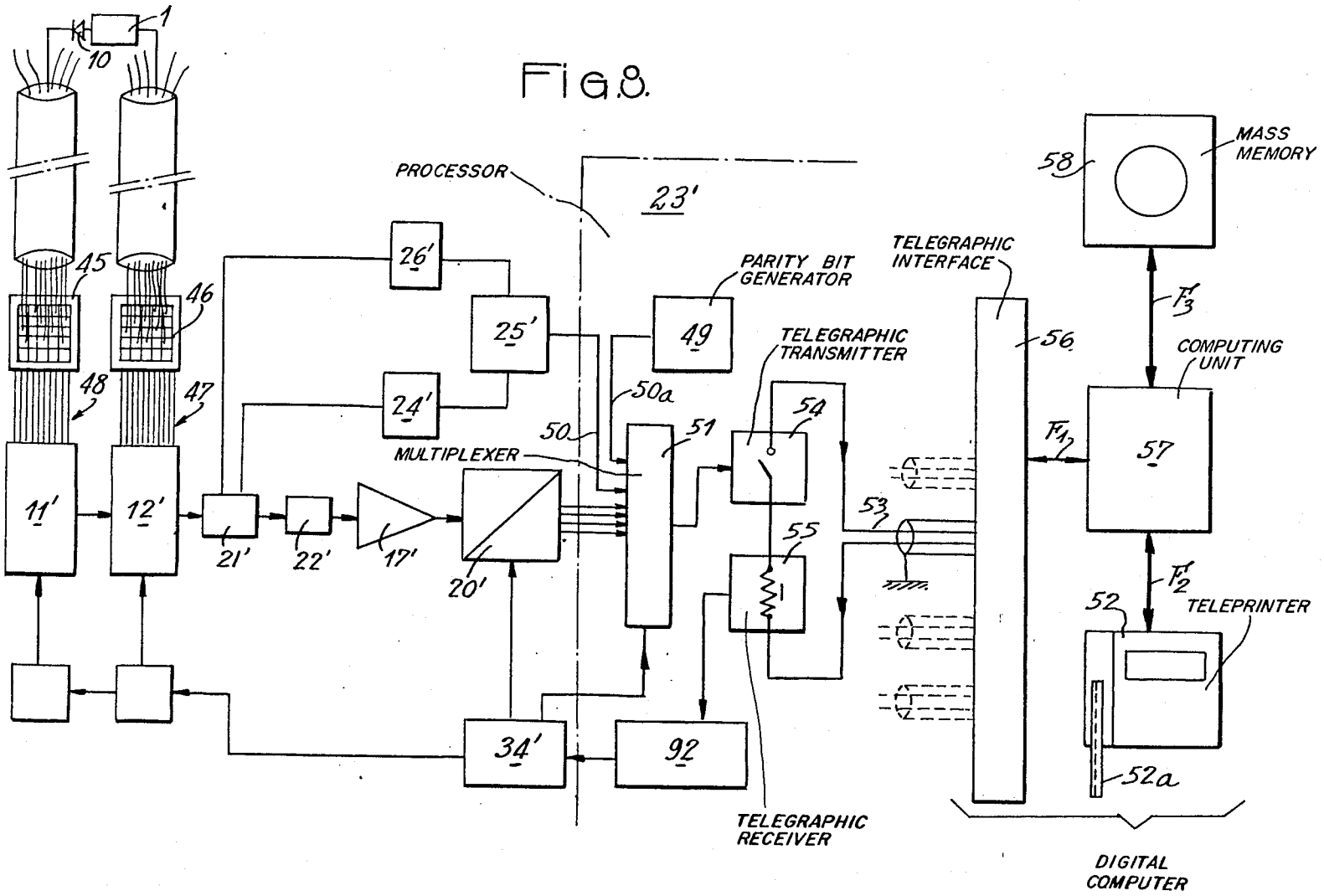
FIG. 8 shows a variant of FIG. 5.
Figure 11:
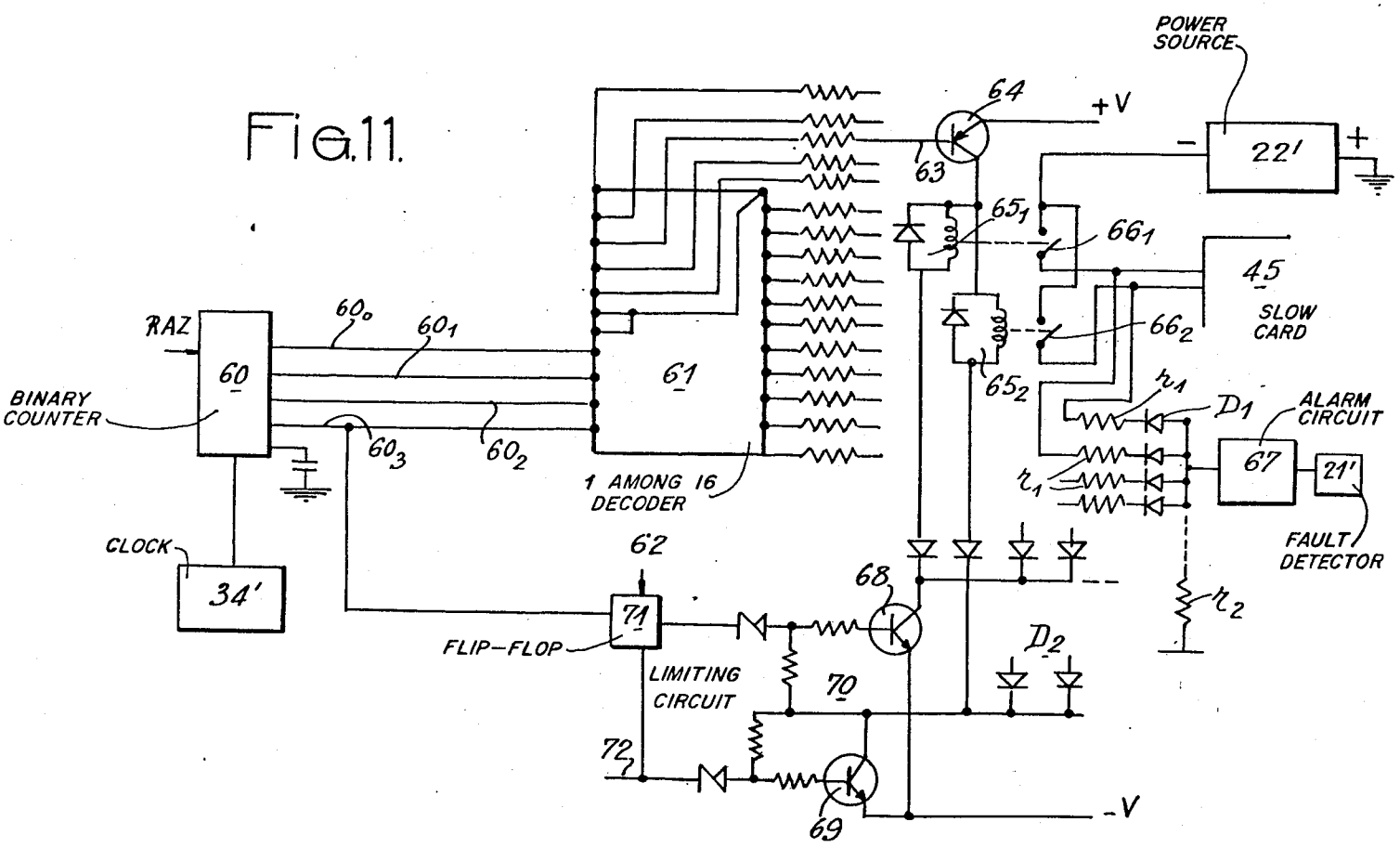

FIGS. 10*a*–10*d* are particular examples of octects obtained in the realization according to FIG. 8;

FIG. 11 shows a portion of FIG. 8.

Figure 1:
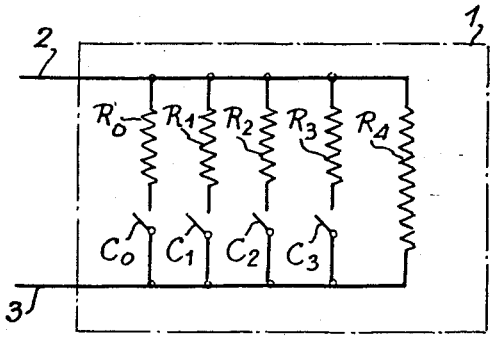

In FIG. 1 is diagragrammatically represented a group 1 of four detecting apparatuses, for example four meters, each of them being indicated by a contact $C_0$, $C_1$, $C_2$, $C_3$ which are each of them associated with a resistance $R_0$, $R_1$, $R_2$, $R_3$. The apparatuses are placed in parallel on a two-wire line 2, 3 which is shunted by a resistor $R_4$. Though a number of more or less than four apparatuses can be designed according to the invention, this number has been chosen as four in view of simplifying the drawing. In the drawing of FIG. 1, the resistors $R_0$, $R_1$, $R_2$, $R_3$ have been represented placed in series with the contacts $C_0$, $C_1$, $C_2$, $C_3$.

Figure 2:
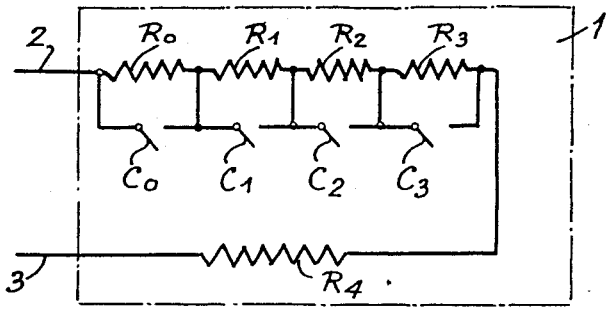

In FIG. 2 are shown the same detecting apparatuses as in FIG. 1, but in this figure the resistors $R_0$, $R_1$, $R_2$, $R_3$ are placed in series on the line 2, 3, the contacts $C_0$, $C_1$, $C_2$, $C_3$ being placed in parallel on the resistances of same index.

Among the detecting apparatuses comprising each a resistor and its associated contact, some can be different from others. For example, if the detecting apparatuses are mainly meters, some of them can be signal indicators whose on or off contact then does not indicate the passage of a quantum but the presence of a trouble such as for example the forcing of a connecting box towards the detecting apparatus or an alarm signal. The appearance of such a trouble will be detected by the device of the invention as if it was coming from a meter changing its state. It is then possible to locate the trouble.

Figure 3:
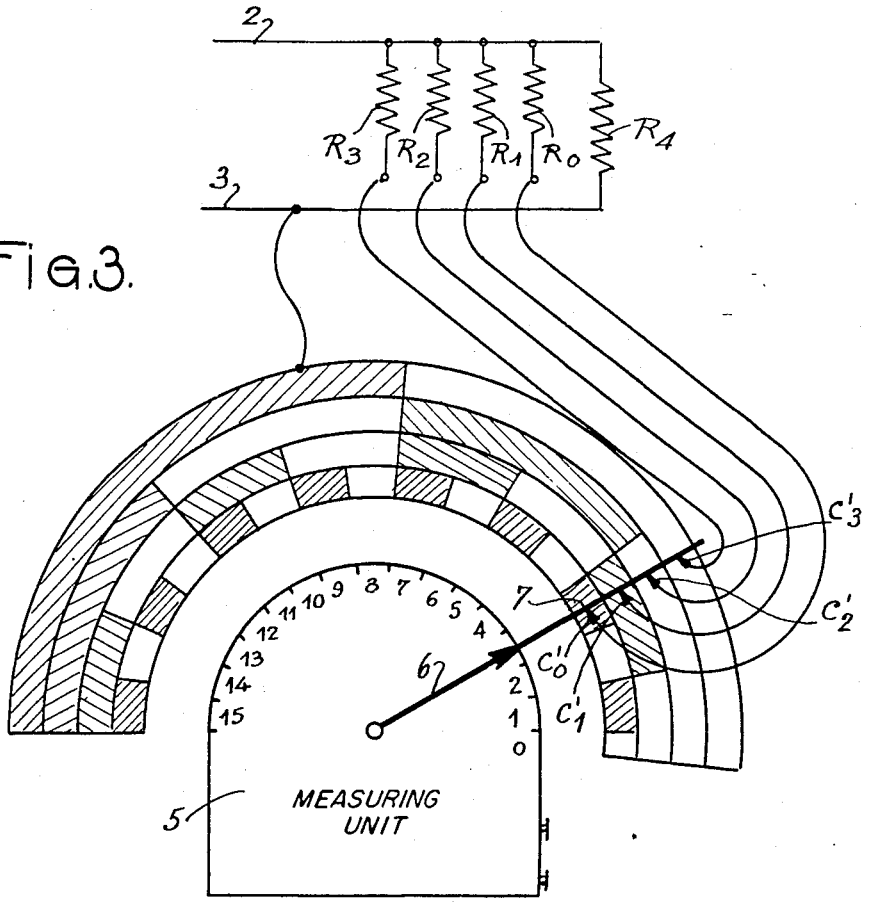

In FIG. 3, is shown a variant of FIG. 1 wherein the resistors $R_0$, $R_1$, $R_2$, $R_3$, $R_4$ are placed in parallel and constitute resistors associated to only one detecting apparatus of a group, said detecting apparatus comprising a binary coder 4 in the shape of an arc of circle in connection with a measuring unit 5, for example a manometer whose needle 6 is extended by a slider 7. Said slider 7 comprises four brushes $C'_0$, $C'_1$, $C'_2$, $C'_3$ each of them being connected to resistors $R_0$, $R_1$, $R_2$, $R_3$. The common of the coder is connected to wire 3.

Upon the motion of the slider 7 driven by the needle 6, the brushes $C'_0$, $C'_1$, $C'_2$, $C'_3$ act as contacts $C_0$, $C_1$, $C_2$, $C_3$ of FIG. 1. In fact, when the slider 7 moves on the binary coder 4, the different resistors are differently connected into the circuit in the very same manner as the corresponding resistors of FIG. 1 were set into the circuit by contacts $C_0$, $C_1$, $C_2$, $C_3$. Then if the line 2, 3 is connected to a source of electric power, the current passing through the line will depend on the displacement of the slider 7, and thus on the position of the needle 6 of the measuring device 5. It has been represented on the measuring device 5 the decimal values associated to the motion of the slider 7 along the binary coder 4 and of which the device of the invention provides a remote reading.

Figure 4:
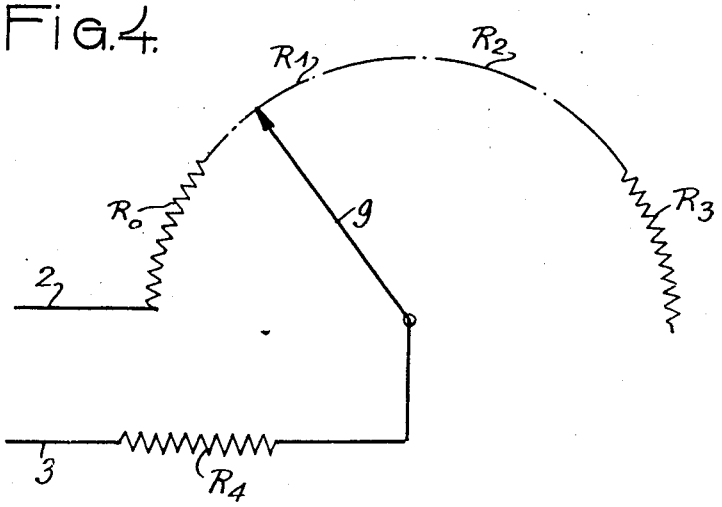

In FIG. 4 is represented a variant of FIG. 2 wherein the resistors $R_0$, $R_1$, $R_2$, $R_3$ are placed in series and constitute a variable resistor whose slider 9 is connected to the wire 2 through some of said resistors $R_0$, $R_1$, $R_2$, $R_3$ and to the wire 3 through the resistor $R_4$. In said realization, the variable resistor can also show a continuous variation of resistance from a minimum or zero value up to the value of $R_0 + R_1 + R_2 + R_3$. The slider 9 acts in the same way as slider 7 of FIG. 3 and it can be mechanically connected to any measuring device. The current passing through the wires 2, 3, when they are connected to a source of electric power, is thus function of a magnitude value indicated by the measuring device and it is a reproduction thereof.

According to the invention, the resistors $R_0$, $R_1$ . . . $R_n$, if it is considered that there are $n$ resistors in a group 1 of detecting apparatuses have different values and said values are such that their combinations are also different from each other and from composing or resultant resistances. For example, the resistors $R_0$, $R_1$ . . . $R_n$ have value in the ratio $2^0$, $2^1$, $2^2$ . . . $2^n$ and the contacts placed with said resistors, either in series or in parallel, are such that they pass from an open or off state to a closed or on state or inversely each time that a known quantum has passed into the related device.

Figure 6:
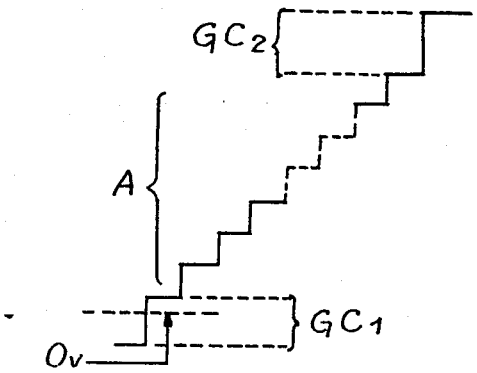
FIG. 6 is a diagram explaining the operation of the device of the invention.
Figure 5:
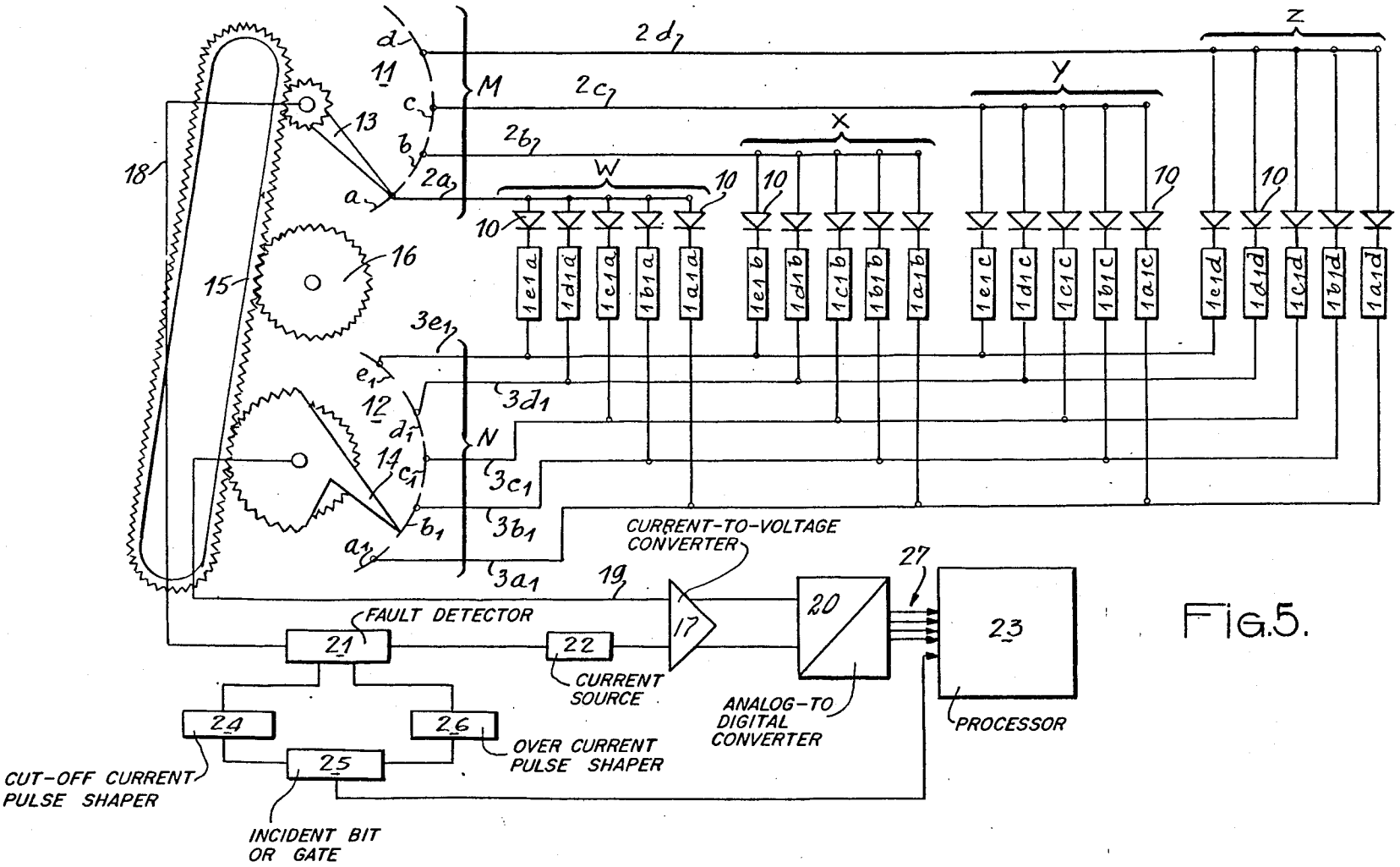

In FIG. 5 are represented four assemblies W, X, Y, Z of five groups of detecting apparatuses but it is obvious that any number M of assemblies of a number N of groups of apparatuses can be used. Each group of apparatuses is equivalent to the group 1 of FIGS. 1 to 5 and they are respectively connected by an insulating diode 10 to a bifilar line equivalent to the line 2, 3 of the preceeding figures and which connects them to two switches 11, 12. Though said switches 11, 12 are preferably electric or electronic switches as represented in FIG. 8, said switches are shown in FIG. 6 as step-by-step mechanical switches. The switch 11 comprises contact-studs $a$, $b$, $c$, $d$, from which start wires $2a$, $2b$, $2c$, $2d$, respectively connected to the M different assemblies W, X, Y, Z or groups of apparatuses. The switch 12 comprises contact-studs $a_1$, $b_1$, $c_1$, $d_1$, $e_1$ from which start wires $3a_1$, $3b_1$, $3c_1$, $3d_1$, $3e_1$ respectively connected to one of the N groups of each assembly W, X, Y, Z.

Each group of apparatus equivalent to the group 1 of FIGS. 1–4, has in FIG. 5 two index letters, one letter corresponding to connection with the contact-studs $a$, $b$, $c$, $d$, of the switch 11 and the other letter corresponding to connection with the contact-studs $a_1$, $b_1$, $c_1$, $d_1$, $e_1$ of the switch 12. For example, the group $1_{b1d}$ is connected to the contact-stud $d$ of the switch 11 and to the contact-stud $b_1$ of the switch 12.

The switches 11 and 12 comprise respectively sliders 13 and 14 driven through an electrically insulated endless chain 15 by a device 16. The whole of the driving mechanism of the meters 13 and 14 is realized by means of the device as represented or by means of any suitable device to provide the slider 13 to sweep up all the contact-studs $a$, $b$, $c$, $d$, in a time at the most equal to the time taken by the slider 14 to sweep up only one contact-stud. Besides, it is necessary that the total sweeping time of the slider 14 be at the most equal to a time T corresponding to the minimum interval of time between two changes in the state of the contacts. This is always realized for the contacts connected to incident-detecting apparatuses since they are usually remaining in a predetermined state and they only change when an incident occurs. The time T is adjusted by the driving device 16 and in the following description the time T has been considered equal to 10 minutes which practically corresponds to the reading of meters. The described device, or equivalent devices, ensures that in the time T, all the groups of apparatuses $1_{ij}$ ($i = a, b, c, d; j = a_1, b_1, c_1, d_1, e_1$) have been connected to the switches 11 and 12 in succession and one by one.

It is to be noticed that the switches 11 and 12 can be inverted if the numbers M and N are equal. Since the switch 11 is faster than the switch 12, it becomes worn out earlier than the latter, and inverting them equalizes their life time.

The sliders 13 and 14 are electrically connected as inputs to an amplifier 17 through two wires 18, 19 and the outputs of the amplifier are connected to an analog-to-digital converter 20. On the wire 18, between the slider 13 and the amplifier 17 have been placed a fault-detector 21 and a source of electric power 22.

The source of electric power 22 is a stabilized source which is insulated from the mains and from industrial and domestic interferences that can be carried by said mains. The source is a constant voltage source in case the resistors of the groups 1 of apparatuses are placed in parallel as shown in FIG. 1 and in that case, the amperage of the current passed by the wires 18, 19, must be transformed into a proportional voltage to be suitably applied to the converter 20. In that case, the amperage-to-voltage conversion is performed by the amplifier 17 which, moreover eventually, adjusts the voltage to take into consideration the characteristics the converter 20 and treatment device 23 connected to said converter. Alternatively, the source of electric power 22 may be a constant current source in case the resistors of the groups 1 of apparatuses are placed in series as represented in FIG. 2; in that case, the device works in a variable voltage way and the amplifier 17 is only used to adapt said voltage to the characteristics of the treatment device 23.

The fault-detector 21 is a two-threshold device which sends a logic signal whenever there an abnormal current for example a current with a value lower than a certain value or higher than a predetermined value corresponding to the maximum amperage which can pass in the absence of incident.

Thus, if the line is cut-off somewhere between a group 1 of detecting apparatuses and the amplifier 17, no current passes into the wires 18, 19 when said group is connected to the source 22 through the sliders 13, and 14. Since this zero current is less than the low threshold value, the fault-detector 21 sends through a shaping circuit 24 an incident bit to one input of a OR gate 25 whose output is connected to one input of the treatment device 23 which then consequently receives the incident bit and records the same instead of the information corresponding to the group of apparatuses which would be obtained if the connection was correct.

If, on the contrary, the line is short-circuited, a current greater than the high threshold value of current passes through the line 18, 19. The fault-detector 21 comprises a current limiting device which comes into operation and sends, through a shaping circuit 26, an incident bit to a second input of the OR gate 25. The incident bit is thus sent to the treatment device which records it in a way similar to the preceeding case.

Now assuming that the connection is correct and all the contacts $C_0$, $C_1$, $C_2$, $C_3$ are in a certain state, a voltage is obtained at the input of the converter 20, said voltage being function of the state of contacts and which corresponds at the output of the converter 20 to logic information with four bits depending on the state of the four meters; for example they can be the re-copy of said state. If all the contacts are open, a certain current nevertheless passes through the line 18, 19 due to the fact that said line is then closed by the resistance $R_4$: it is the minimal current which must pass through the line.

FIG. 6 shows the current amperage in the line 18, 19 for different state of the contacts $C_0$, $C_1$, $C_2$, $C_3$ of FIG. 1. In A have been shown the 16 possible state of the current for the combinations of the four resistances $R_0$, $R_1$, $R_2$, $R_3$. The current guard showing that the line is not cut off even if the four contacts are open is represented in $GC_1$; samely $GC_2$ represents the current guard indicating that the line is short-circuited.

As explained in the above disclosure, if the line is faulty (short-circuit or cut-off), the recopy bits coming from the considered group of detecting apparatuses have a modified meaning and an incident bit is produced.

The bits coming from the converter 20 are sent, through wires 27 in a number equal to the number of resistors of each group 1 of apparatuses, to the treatment device 23 which records into a memory the number of contact reversings representing the passage in each apparatus of a known quantum. The treatment can be locally or remotely done, and FIGS. 7 and 8 show, as an example, the constitution of the treatment device in these two cases.

The grouping represented in FIG. 5 considerably reduces the number of lines with respect to other known realizations for remotely reading meters and various apparatuses. In fact, in this example, for four wires connected to the switch 11 and five wires connected to the switch 12, there are $4 \times 5 = 20$ groups of 4 meters, that is 80 meters; for 32 lines with two wires connected respectively to switches 11 and 12, there would be 1,024 groups of meters, which, while considering 4 meters per group, would result in 4,096 meters, that is the number of meters for an large block of buildings.

Figure 7:
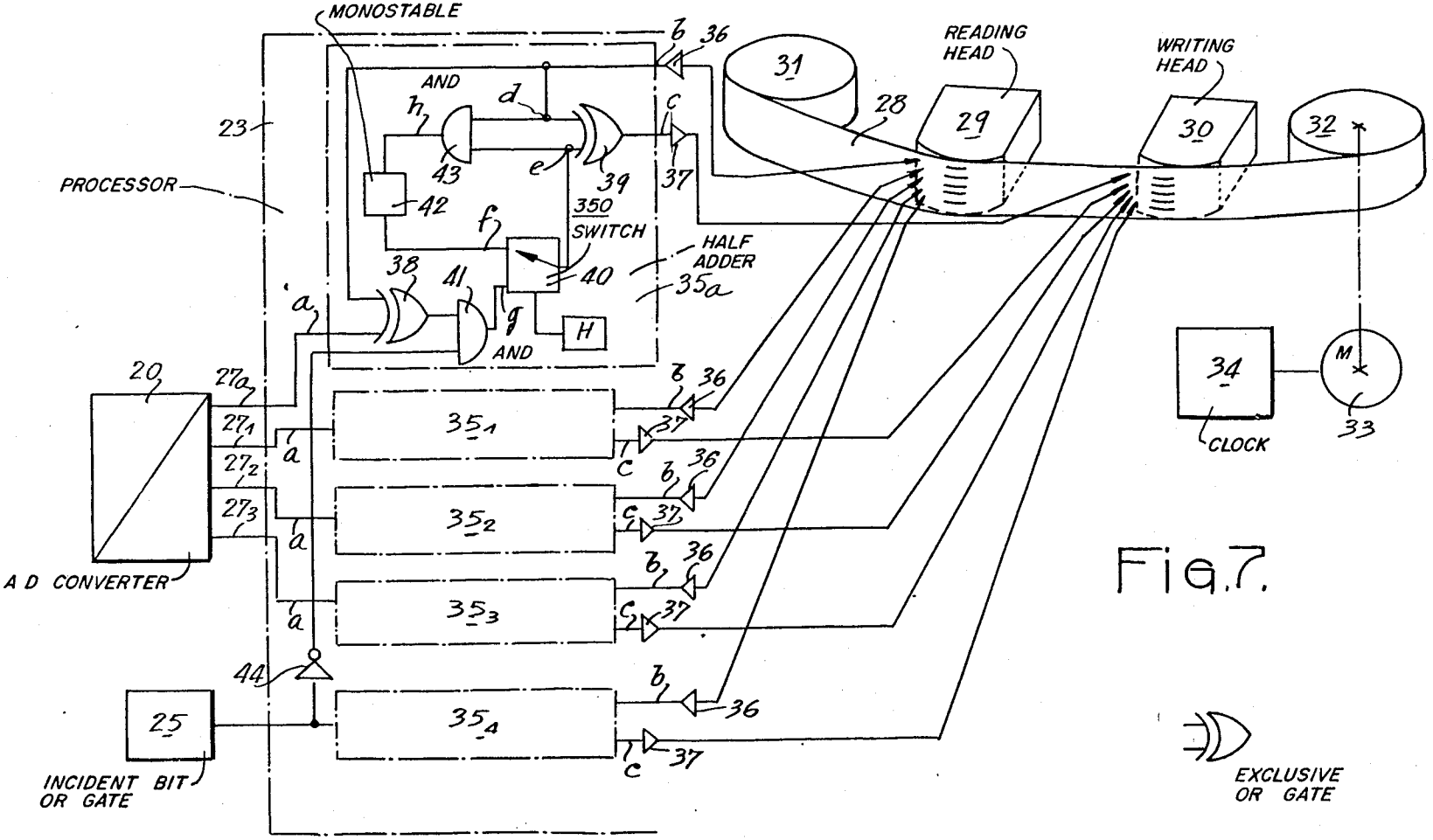
FIG. 7 shows a portion of FIG. 5 in a particular application.

FIG. 7 shows a realization of the treatment device 23 in the case of a magnetic tape recorder for a local recording, and limited to the reading of detecting or measuring apparatuses of which the amount of quanta which have been passing through has a particular meaning, as is the case for energy meters.

The treatment device 23 comprises a memory in the form of a magnetic tape 28 and two heads 29 and 30 respectively for reading and writing. The reading and writing heads can be under the shape of only one head, but they have been distinctly represented for an easier explanation. The magnetic tape 28 is rolled up on two drums 31 and 32 through a winding and unwinding device 33 controlled by a clock 34 which also controls the driving device 16 of the switches 11 and 12 of FIG. 5. The unwinding step is performed during a time smaller than the time T = 10 minutes previously defined, then the device 33 winds up the tape for a new memorization.

The tape 28 comprises fives tracks in the case of groups 1 comprising four resistors $R_0$, $R_1$, $R_2$, $R_3$ and their associated contacts, plus the fifth resistor $R_4$ according to FIGS. 1–4. Four tracks correspond to the signals coming from the four contacts associated with the resistors $R_0$, $R_1$, $R_2$, $R_3$, and passing through the converter 20 comprising for that purpose four output wires $27_0$, $27_1$, $27_2$, $27_3$ and through four adding elements $35_0$, $35_1$, $35_2$, $35_3$, the action of which will be further indicated and which respectively correspond to the resistances $R_0$, $R_1$, $R_2$, $R_3$. The fifth track corresponds to the signal coming from the OR gate 25 of FIG. 5, i.e. to the incident bit through a fifth adding element $35_4$.

The different adding elements $35_0$, $35_1$, $35_2$, $35_3$ are, each of them, provided with two inputs *a*, *b*, respectively connected to the output of the converter 20 and to the output of the reading head 29, while the output *c* of these adding elements is made on the writing head 30. Reference numbers 36 and 37 designate respectively reading and writing amplifiers.

The operation of the device is given hereinbelow while considering only one detecting apparatus and in assuming that scanning of the on or off state of the contacts of all the detecting apparatus is made — as above indicated — every time T = 10 minutes.

Besides, it is assumed to have already in memory on a track of the tape 28, a word having a certain number of bits representing at the moment $t_0 - 10$ minutes, the number of state changes supported by the detecting apparatus from the last reading operation. The last bit of that word, or a separated bit, is the bit mentioning the on or off state that had the contact of the apparatus at that moment $t_0 - 10$ minutes. At the moment $t_0$, there is also a state bit coming from converter 20.

It is desired to put in memory, instead the previously memorized word, a new word adding or not adding 1, depending on whether the state of the meter at the moment $t_0$ is different or not different from its state at the moment $t_0 - 10$ minutes. This new word thus indicates the number of quanta consummated up to the moment $t_0$. This word is recorded on the tape 28 and could, in its turn, be incremented by 1 after comparison of the present state with a new state at the moment $t_0 +$ 10 minutes.

Those words are placed on the tape 28 in such a way that, on the reading step as well as on the writing step, the chronological sequence will go from the less significant bit to the more significant bit. Each bit of the result will be obtained by adding two bits, one for the word to be added up and one for the state change or for the carryover. The adding element 35 is thus reduced to what is called in the technique an half-adder.

If the bits to be added are called A and B, respectively at the moments $t_0 - 10$ and $t_0$, there is, for example, the following truth Table:

| | |
|---|---|
| A | 0 1 0 1 |
| B | 0 0 1 1 |
| Result of the addition = D | 0 1 1 0 |
| Carrying over for the next addition = E. | 0 0 0 1 |

The result of the addition D corresponds to the definition of the "exclusive OR" operation.

As to the carrying over, it corresponds to the AND operation and is written E = B.A. The various half-adders 35 simply perform the various sequences of operations.

For that purpose, each half-adder 35 comprises a first exclusive OR circuit 38 having a first input connected in *a* to the corresponding output of the converter 20 and a second input connected in *b* to the output of the reading head 29.

The output *c* of the half-adder 35 is connected to the reading head 30 and to the output of a second exclusive OR circuit 39 having two inputs *d* and *e*. The input *d* of the OR circuit 39 is connected through *b* to the reading head 29 and is also connected to one of the two inputs of the exclusive OR circuit 38. The input *e* of the OR exclusive circuit 39 is connected to the common of a switch or multiplexer 40 with two positions *f* and *g* controlled by a clock H connected to the general clock 34 which controls all the mechanical operations.

One of the studs of the switch 40 is connected as an output to the exclusive OR circuit 38 through an AND circuit 41 which receives on one of its two inputs the incident bit: when there is no incident, this circuit is passing. The position *f* of the switch 40 is connected by a delay circuit 42 to the output *h* of a logical AND circuit 43 having two inputs respectively connected to the inputs *d* and *e* of the exclusive OR circuit 39. The inputs of the AND circuit 43 are thus connected to the reading head 29 and to the common of the switch 40.

Each half-adder 35 is thus designed to add one unit to the consumption already memorized if the state transmitted by the converter 20 is at the moment $t_0$ different from that existing during the preceeding interrogation at the moment $t_0 - 10$ minutes, and in absence of any incident bit.

This preceeding state is indicated by the last information unit of the word memorized at the moment $t_0 - 10$ mn. The present state at the moment $t_0$ arrives from the converter 20. The comparison of the preceeding information element with the present information element is made in the exclusive OR circuit 38. Through the switch 40 in position *g*, the result of this comparison acts in *e* as the carrying-over of an addition. The next carrying-over bits are obtained through the AND circuit 43, the delay circuit 42 which can be a monostable and whose delay is equal to the time separating the reading of two successive bits, and through the switch 40 of which the position has changed to position *f* after the reading of the first bit or state bit. The result of the addition appears in *c* at the output of the second OR exclusive circuit 39 and is sent through the amplifier 37 and the writing head 30 to the memorization tape 28 on which has already been written the preceding word.

The following table determines the bits appearing in all points of the half-adder 35 considered and at every moment in considering that the word is read by the reading head 29 and rewritten by the writing head 30 similarly if in *a* there is the same state as the one memorized 10 minutes ago, and increased by 1 if in *a* there is the opposite state.

| FIRST BIT | | NEXT BITS | |
|---|---|---|---|
| H | 0 0 0 0 | H | 1 1 1 1 |
| e and g | connected | e and f | connected |
| b | 0 0 1 1 | b | 0 0 1 1 |
| a | 0 1 0 1 | a | X X X X |
| f | X X X X | f = e | 0 1 0 1 |
| g = e | 0 1 1 0 | g | X X X X |
| h = b.e | 0 0 1 0 | h = b. e | 0 0 0 1 |
| = carry over = | of the next bit | | |
| f | | | |
| c | 0 1 0 1 | c | 0 1 1 0 |
| If b = a, c = $\overline{b}$ | | If preceeding carry over = 0, c = b | |
| If b = $\overline{a}$, c = $\overline{b}$ | | If preceeding carry over = 1, c = $\overline{b}$ | |
| Carry over h for the next bit = 1 if b = $\overline{a}$ and if simultaneously | | Carry over h for the next bit = 1 if present carry over = 1 | |

-continued

| FIRST BIT | NEXT BITS |
|---|---|
| b = 1 | and simultaneously b = 1 |

with X meaning any bit without any influence on the final result.

When an incident occurs on the line which causes the appearance of an incident bit at the output of the OR gate 25 (FIGS. 5 and 7), said incident bit is, through an inverter 44, connected through *a* to the second input of the above mentioned AND circuit 41.

The AND circuit 41 is thus an AND gate which receives a 1 when the incident bit does not appear and a 0 when the incident bit appears. Upon appearance of the incident bit, said 0 blocks the exclusive OR circuits 38 of all the adding elements $35_0$, $35_1$, $35_2$, $35_3$ since a 0 is then indicated at the output of the whole unit composed by the circuits 38 and 41. In this case the four informations coming from the group of the relevant apparatuses are then not taken into consideration. The incident bit is directly transmitted to the writing head 30 through the half-adder $35_4$ and is treated as an information coming from said group of detecting apparatuses.

After the reading of all the apparatuses, the clock 34 causes, through the device 33, the winding of the tape 28 and after 10 minutes the clock 34 will cause a new unwinding of said tape 28.

FIG. 8 shows the complete diagram circuit of a device according to the invention with a remote transmission by telegraphic lines. This device is an electromagentic and electronic arrangement, and it is obvious that the mechanical elements of FIG. 5 can be substituted by their equivalents.

To illustrate the equivalence of the elements between FIGS. 5 and 8, the elements of FIG. 8, which are equivalent to those of FIG. 5, have been given the same reference number to which has been added a prime sign (′).

FIG. 8 shows only one group 1 of detecting apparatuses and its associated isolating diode 10 to prevent the current to form a loop with the other groups of apparatuses. The outputs 2 and 3 of the various groups of apparatuses are grouped by two terminal-boxes 45 and 46 to two line switches 11′ and 12′ which are connected together to act as switches 11 and 12.

The two switches 11′ and 12′ are preferably cabled on cards respectively called "quick card" and "slow card" and they are each equipped with relays corresponding to the contact-studs of the switches 11 and 12 of FIG. 5. It will be later considered that there are 32 relays per switch. As it has been previously explained, the various detecting apparatuses are adapted to convey informations in an on/off mode, i.e., by all or nothing and are, for example, meters of gas consumers or still apparatuses detecting a pressure, a global flow in instantaneous value, a current amperage in a distributing transformer, alarm detectors (gas leaks, breach of a local or break open of the box grouping the leading-in cables of various apparatuses, electrical disjunction, boosting, too high temperature of a transformer) in connection with a particular code associated with a particular grouping of resistances and contacts.

The relays which are used within the switches are typically of the type known under the name of "reed relays" but mercury relays can be utilized. They can also be substituted by field effect switching transistors for analogue voltage.

A particular example is given below while considering a block of building having five levels with 4 meters by level and only one column per building. Each building is connected through a special line of a network 47 at the slow card 12', while the five levels of each building are connected to the quick card 11' by five lines of a network 48. Said example is of course not limitative since cabling can be easily adapted to the architecture of a block of buildings though it can always be reduced to a matrix, for example a square matrix of 32 × 32. In the case of five buildings having five levels each or of equivalent groupings as five buildings having three levels and five buildings having two levels, they correspond to a square sub-matric of 5 × 5 in the general matrix of 32 × 32.

The two cards 11' and 12' will be described in a more complete way with reference to FIG. 11. As in FIG. 5 for the switches 11 and 12, when the relays of the slow card runs by one step, the relays of the quick card make a complete cycle of 32 steps. Each such step scans the apparatuses of one group. The complete scanning of 1024 steps is made in 164 seconds in a particular example utilizing the reed relays, through control orders sent by a time base 34' acting as the clock 34 of FIG. 5 but synchronized on the 50 or 60 Hz mains.

The switching cards 11' and 12' are connected through an incident detector 21' and a constant voltage source 22' to an amplifier 17' working as a current-to-voltage converter in the case where the group 1 resistors are connected in parallel according to FIG. 1. In this case the current sent by a group of apparatuses and passing through a particular relay of each of the two switching cards 11' and 12' is converted in a proportional voltage which is decoded through an analog-to-digital converter 20' also controlled by the time base 34' and restituting in the form of logical signals 0 or 1, the state of the contacts associated with the resistances of the group of the detecting apparatuses. These signals are sent to a processing device generallly represented by reference number 23'.

As it has been noticed with reference to FIG. 5, when an incident appears on the line, that is between a group of apparatuses and the converter, the incident detector 21' sends an incident bit to the output of an appropriate circuit 25' through a circuit 24' in case of a cut-off on the line and through a circuit 26' in case of an overcurrent due to a short-circuit. The incident bit is sent to the processing device 23' which represents the device 23 of FIG. 5 in this particular realization.

The processing device 23' comprises a parity generator 49 generating the parity bit from the signals coming from the converter 20 and the incident generator 21'.

The incident bit and the parity bit are sent by two wires 50 and 50*a* to a multiplexer 51 which also receives the logic signals coming from various groups of detecting apparatuses through the converter 20'. The multiplexer 51 is synchronized by the clock 34'. The various informations applied to the multiplexer 51 are thus timed in the form of an octet for example of a total duration of 160 milliseconds in the case where the device is synchronized on a 50 Hz mains.

Figure 9:
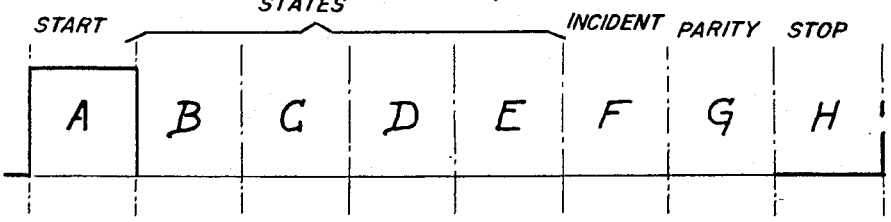
FIG. 9 shows the formation of a word of 8 bits or octet.

FIG. 9 shows an octet A B C D E F G H. An octet "series" has always at the beginning a start bit A of a logical level 1 and at the end of the message a stop bit H of a logical level 0. The other bits B to G have a level of 0 or 1 depending on the messages to which they correspond. In the present case, the group of the four bits B to E corresponds, in the absence of incident, to the state of the four contacts associated to the apparatuses of a given group. For example the level 0 corresponds to an open or off contact, the level 1 corresponding to a closed or on contact. The bit F corresponds to the presence or to the absence of the incident bit and the bit G is the parity bit which is equal to 1 if the bits B to F have an odd number of levels 1, and is equal to 0 if the bits B to F have an even number of levels 1.

Figure 10A:
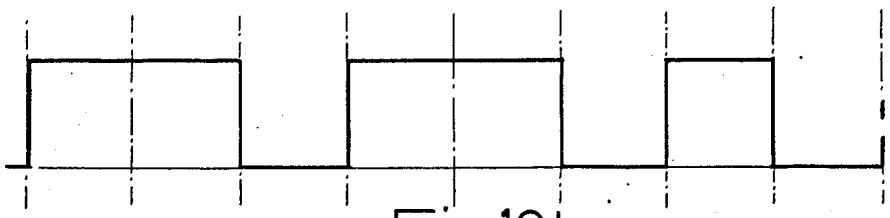
Figure 10B:
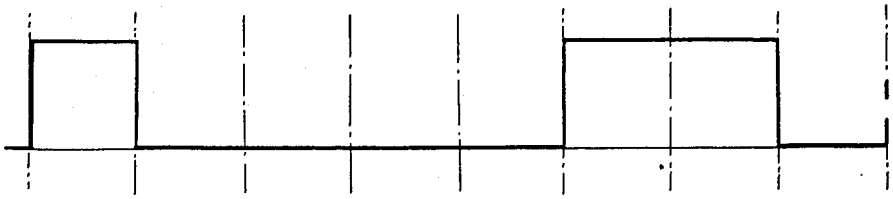
Figure 10C:
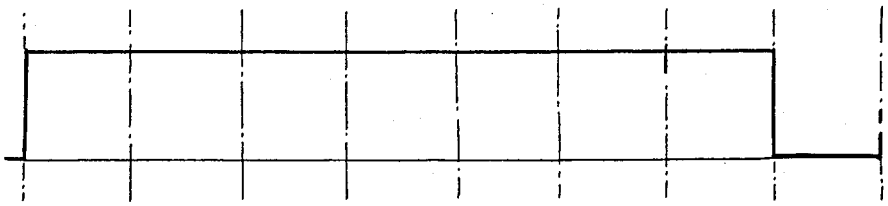

In FIG. 10*a* is represented an octet corresponding to the contacts: $C_0$ closed, $C_1$ open, $C_3$ and $C_4$ closed; there is no incident and the parity is 1, because three bits among the bits B to F have a level 1. This is what may be called a normal octet with no particular incident.

When the incident bit appears, the four bits B to F corresponding to the measuring apparatuses, change meaning. If the line 18, 19 is open, all of them are at level 0 (case of FIG. 10*b*) and if the line 18, 19 is short-circuited, all of them are at level 1 (case of FIG. 10*c*). With respect to the parity bit, it is of 1 in the case of an incident: of an open line 18, 19 (only one bit B to F at level 1); and also 1 in case of an incident: short-circuit (all five bits B to F at level 1).

Figure 10D:
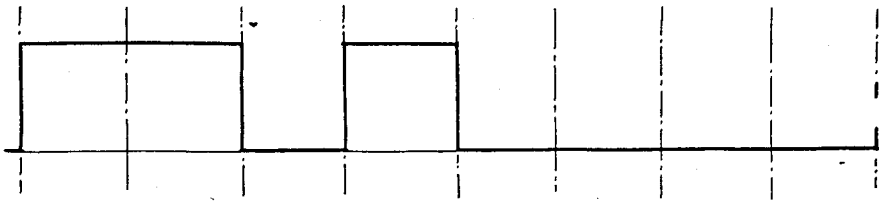

In FIG. 10*d*, is represented an octet corresponding to a measuring apparatus equipped with an assembly equivalent to that of FIG. 3. The octet becomes reduced to 1 0 1 0 considering only the bits corresponding to the states of the contacts, which corresponds to $1 \times 2^3 + 0 \times 2^2 + 1 \times 2^1 + 0 \times 1 = 10$ units.

The 32 × 32, i.e. 1024 octets of a sequence correspond to the complete scanning of 1024 groups of apparatuses connected to the switches 11' and 12' and sent one after one every 10 minutes. Each octet having a place or address which is well determined and always the same in the sequence, can be assigned a particular meaning, for example some addressed octet can, in case of incidents, control the release of an alarm or a print on a terminal teletype 52 the connection of which with the multiplexer 51 is better shown in the following disclosure.

The multiplexer 51 is coupled to a telegraphic line 53 by an emission-reception unit 54–55 connecting said line, for example, to an electrical supply source of + 48 volts for the logical level 0 and of −48 volts for the logical level 1, or to any other voltage according to the conventional rules to be complied with for the transmission on the telegraphic line 53 considered. Said line is connected, by a telegraphic interface 56 which can receive several lines similar to the line 53, to a central computing unit 57 whose connections are diagrammatically represented by arrow F1. The central computing unit 57 thus receives the sequence of 1024 octets through the emission relay 54 while the reception relay 55 receives from the central unit 57 a signal corresponding to a start of the scanning and transmitted to the clock 34' through a decoding circuit 92 which recognize the different messages coming from the central processing unit transmitted through the telegraphic line 53 and designed for controlling the base of time 34'.

The computing unit 57 is connected to peripheral elements such as a mass memory 58 and to teletype 52 comprising a perforated tape reader 52*a* and with which said computiting unit holds a dialogue as diagrammatically represented by arrows F2 and F3.

The computing unit 57 has, for example a memory of four kilowords on which is stored the utilization program and which takes over all the computations of the consumption incrementation from the informations taken on the telegraphic interface 56 of a capacity adaptable to the configuration of the mains.

Program changes can be introduced through the reader 52*a*. The teletype is used to present in clear some informations of local use, and to perform the control and the survey of the whole device and to control sound alarms in case of incidents.

In the above disclosure, the switches or cards 11' and 12' have not been described in detail. FIG. 11 shows, as an example, one of these cards, namely the quick card. The quick card comprises a binary counter 60 receiving at its input a synchronization pulse every 160 milliseconds from the base by time 34' in FIG. 8 and making the counter 60 to advance of one step, and acting on a resetting or return-to-zero control RAZ. The four outputs $60_0$, $60_1$, $60_2$, $60_3$ of said counter 60 are connected both to the input of a "1 among 16 decoder" 61 and to an AND gate 62. The decoder 61 comprises 16 outputs 63 each of them being connected by a transistor 64 supplied under a low voltage + V to two coils of reed relays $65_1$ and $65_2$ in order to constitute 32 switching possibilities as it is explained in the following disclosure. When closed, the contacts $66_1$, $66_2$ of the relays $65_1$ and $65_2$ connect to the voltage source 22' to the terminal-box 45 of FIG. 8, and to a resistor-diode circuit $r_1$, $D_1$,$r_2$, which is also connected to temporized alarm 7 circuit 67 giving a signal for an i.e., an alarm circuit that is activated after a time delay during which a continuous activating signal is applied, input voltage higher than a given threshold. The circuit 67 is connected to the circuit 21' detecting the incident and shown in FIG. 8.

The coils $65_1$ and $65_2$ of the reed relays are connected by diodes D2 to the collector-emitter circuit of transistors 68, 69, supplied under a low voltage −V and the bases of which are connected through a limiting circuit 70 to a flip-flop 71 which is also connected to the output $60_3$, the slowest output of the binary counter 60. The output 72 of the flip-flop 71 constitutes the output of the card.

The slow and quick cards 11' and 12' are generally similar. The thirty-two relays of the slow card work thirty-two times less often than the relays of the quick card, thus at the maximum normal operation duration of the quick card (5 to 10 years), the cards can be permuted to double their operating life time.

Along with a quick card described in FIG. 11, a device has been designed to check to switching and detect the permanent sticking of a relay contact 66 in superposition with the switching of other contacts, for example the superposed sticking of the contacts $66_1$ and $66_2$.

The quick card sends the voltage of the source 22', i.e. for example -24 volts, to the different lines equivalent to lines 2,3 of FIG. 5. At the output of each contact 66, only two of them (the contacts $66_1$ and $66_2$) being represented in FIG. 11, and the input of the alarm circuit 67, there has been inserted a resistor-diode circuit such as the circuit $r_1$, $D_1$, $r_2$ of the FIG. 11. The thirty-two resistor-diode circuits form a totalizer and the resistors $r_1$, $r_2$ are computed for the consumption of a low current and to give in this example an output voltage of about 2.5 volts not sufficient to switch the alarm circuit 67. If two relay contacts are simulataneously stuck, the output voltage of the totalizer device becomes equal to −5 volts activating said circuit after a given delay, calculated to be a little longer than the maximum passage time of a relay to the next one in normal working operation of the relays (bridge time) : said delay can be of 10 milliseconds.

The logical voltage of this alarm circuit is thus sent through the incident detecting circuit 21' as input to the multiplexer 51 of FIG. 8 to show an incident bit in the corresponding octet.

A particularly advantageous arrangement for the switching of the thirty two relays has also been represented in FIG. 11. Said advantageous arrangement comprises the "1 and 16" decoder 61 which controls simultaneously two relay coils such as $65_1$, $65_2$ by a transistor 64 connected to each output of the decoder 61 and to flip-flops every 16 steps the supply feeding from the first group of 16 relays on a second group of 16 relays through the flip-flop 71 which is controlled by a pulse generated by means of the binary counter 60. The diode system $D_2$ associated with each relay coil is designed to prevent the current to be looped by the other relays.

At the end of the switching of the thirty-two reed relays, the output pulse in 72 of the flip-flop 71 is utilized in two ways : on the quick card particularly shown in FIG. 11, it is sent as a synchronization input to the slow card to make it advance by one step ; on the slow card it is sent to the blocking-unblocking circuit of the time base to stop the synchronization at the end of a cycle. The output pulse of the quick card is thus sent to the input of the binary counter 60 of the slow card which then does not receive the synchronization pulse coming from the time base 34'.

The embodiment shown in FIG. 11 is not restricted to the particular number of relays shown. Thus, for the general arrangement described earlier, in which an N input position switch and an M output position switch is used, at least one of these switches can be equipped with an even number P of relays defining a first and second group of P/2 relays, with each having an input and an output terminal. The input terminals of the relays of the first and second group of P/2 relays are respectively connected two-by-two to the output terminals of P/2 static relays, whose inputs are connected respectively as P/2 outputs to a "1 among P/2 decoding unit." The input of this decoding unit is connected to the output of a binary counter and to the input of a two-output flip-flop. The output terminals of the first group of P/2 relays are connected together to one of the two outputs of the flip-flop while the output terminals of the second group of P/2 relays are connected together to the other output of the two outputs of the flip-flop, with the output of the flip-flop constituting the output of the N input or M output position switch so connected.

The various return-to-zero RAZ of the binary counter 60 of the quick card and of the homologue counter of the slow card are performed before the beginning of the scanning as operating safety steps since the two counters must return by themselves to zero at the end of the scanning. The return-to-zero is controlled by a special code issued from the decoding circuit 92 and applied on the input RAZ of the binary counter 60.

In the realization of FIG. 8, it has been designed to make the switches 11' and 12' to a cyclically advance under the control of the time base 34'. It can be of interest to make an addressing of the switching cards, i.e. to let the switches take a position at any address given by the computer. In that case, the binary counter 60 is not used and the outputs $60_0$, $60_1$, $60_2$, $60_3$ are directly controlled by the decoding circuit 92 which controls also an additional input 62 of the flip-flop 71.

Instead of interrogating the meters by means of a direct current, it can be of interest to work with an alternating current. For that purpose, it is only necessary — without changing any principle of the invention — to replace the identification resistances of the detecting apparatuses by impedances, the power source being then an alternating current source superposed to a direct current source to prevent an alternation of the polarity of the resulting source.

We claim:

1. An electrical apparatus for detecting, transmitting and storing in a remote central recording device under digital form the total number of events which have occurred from a known origin of time in each of a large set of indicating devices and for converting said digits in such a way that said number of events may be processed comprising:

individual means controlled by the relevant indicating device causing the change of state of an alternating electrical switch associated with an electrical impedance upon the occurrence of any relevant event such as the fact that a predeterminate amount of a physical magnitude has passed through a given indicating device;

means for electrically grouping several such alternating electrical switches associated each with an electrical impedance whereby the switches and the impedances are electrically connected together and with an additional failure detecting impedance not associated with any switch in such a manner that the impedances may be combined and wherein any individual switched impedance and said failure detecting impedance and any combination thereof is different from any other resultant impedance and combination thereof;

means for electrically connecting each of a plurality of such electrical groups of several alternating electrical switches associated each with an electrical impedance and said failure detecting impedance to one of M lines of a first lattice on the one hand and to one of N lines of a second lattice on the other hand, whereby any one among the M lines of the first lattice may be connected to any one among the N lines of the second lattice through only one of said electrical groups of several alternating electrical switches and said failure detecting impedance, the maximum number of groups of switches so connected to both lattices being thus M times N;

means for cyclically scanning every group of switches by serially electrically energizing during short durations on the one hand each line of the M lines lattice and, during the energizing of said line, on the other hand each line of the N lines lattice, whereby the individual states of said electrically grouped switches are sensed, said sensing resulting in an elementary electrical current of short duration which is an image of said individual states of switches, and wherein the interval of time between two consecutive scannings of any group of switches is shorter than the minimum normal time interval covering two consecutive changes of state of any switch of said group;

analog-to-digital converter means receiving successively the elementary electrical currents of short durations which are each the image of the individual states of a group of switches and serially transmitting said elementary electrical currents and translating said image into an elementary logical binary electrical current the highs and lows of which represent the on and off states of the relevant individual switches;

a first memory means where said on and off states of the individual switches are stored;

means comparing the last sensed state of each individual switch with the state of the same switch sensed on the immediately preceding scanning as it is stored in a second memory means, whereby if the state of a switch is unchanged the record of the indication of the dial corresponding to the indicating device controlling said switch is unchanged, whereas if the state of a switch is altered with reference to the state of the same switch on the previous scanning the corresponding record of the indication of the dial is altered in a manner corresponding to the manner it would be altered if it were directly controlled by the relevant indicating device; and means to transfer the recording of the last scanning as it is in the first memory means to the second memory means in place of the recording of the preceding scanning in order that a new comparison of the consecutive states of each switch at two successive scannings may be performed after the next scanning of the switches.

2. The apparatus as set forth in claim 1, wherein some groups among said plurality of groups correspond to only one of said device associated with a plurality of impedances, the corresponding switches being constituted by brushes of a logical coding device.

3. The apparatus as set forth in claim 1 wherein some groups among said plurality of groups correspond to only one device associated with a single step by step variable impedance, and a switch which is constituted by a slider switching device.

4. The apparatus as set forth in claim 1, wherein an additional impedance is connected in each group whereby an open or short in the connection between said group and the converter means may be detected.

5. The apparatus as set forth in claim 1, wherein each switch of each group is in series with its associated impedance to form a switching unit, the units of each group being arranged themselves in parallel fashion.

6. The apparatus as set forth in claim 1, wherein each switch of each group is in parallel with its associated impedance to form a switching unit, the units of each group being arranged themselves in series.

7. The apparatus as set forth in claim 1, wherein said means for electrically connecting comprises:

an N input position switch, each input contact of which is respectively connected to one sensing line of one group in each one of a plurality of assemblies of said groups and having only one output contact connected to said converter means through one of the wires of the two wire connection;

an M output position switch, each output contact of which is respectively connected to the other sensing line of all the groups in one assembly and having only one input contact connected to said converter means through the second wire of the two wire connection;

a device to cyclically drive said N and M switches whereby when the N input position switch has completed sweeping the N input positions, the M output position switch will advance only by one step, and whereby every time the N position switch has swept all the N positions, said N and M switches have been sequentially connected to all the MN groups of units, the driving cycle of the M output position switch being shorter than the minimum time interval covering two changes of state of the switches of the groups.

8. The apparatus as set forth in claim 1, wherein said indicating devices are counters detecting the passage of a given magnitude, the change of state of each switch occurring after the previous passing of a known quantum of said given magnitude, said comparing means then adding and storing the state changes of each counter, whereby the sum of these state changes represents the total number of quanta counted from a given origin.

9. The apparatus as set forth in claim 1, wherein said comparing means includes a half-adder comprising:

means to connect a first input of the half-adder to a memory having stored the information received during a just preceding scanning of the various groups of units;

means to connect at the time of the new scanning a second input of the half-adder to the output of said converter means;

means to connect the output of the half-adder to said memory for storing the new information received from the units.

10. The apparatus as set forth in claim 1, wherein:

a fault detector is connected between the group being scanned and said converter means for sending a control signal to said comparing means when said sensing lines contain signals indicating out-of-limit conditions of said group being scanned, and said comparing means includes blocking means connected to the fault detector to block the information from the group being scanned upon receipt of said fault detector control signal.

11. The apparatus as set forth in claim 1, wherein said comparing means comprises:

a magnetic tape; means to drive said magnetic tape; a first head to store on said magnetic tape information received during a just preceding scanning of the various groups;

a second head to store on said magnetic tape information received at the time of the new scanning; and a number of half-adders equal to the number of switches of each group, a half-adder being set to each switch, each half-adder comprising a first two-input exclusive OR circuit (30) of which one input (a) is connected to a given output of the converter means (20) and the other input (b) is connected to the output of the first head, the output of the first OR circuit being connected to one terminal of a two-way switch (40), the second terminal of which is connected, through a delay circuit (42) having a delay of a one bit duration, to the output of a two input AND circuit having one input connected to the output of the first head and to one input of a second two-input exclusive OR circuit (30 of which the second input is connected both to the common point of the two-way switch, and to the second input of said two input AND circuit;

means connected to the tape driving means to control passing said two-way switch from on terminal to the other terminal between two successive scannings, the output of the second OR circuit being connected to the second head, whereby if between said two successive scannings there has been no change in the state of a given switch, the information on the memory tape remains without change while said information is increased by one quantum if between said two successive scannings there has been a change in the state of said switch.

12. The apparatus as set forth in claim 7, wherein the N input position switch and the M output position switch are both electromechanical switches, the N input contacts and the M output contacts of which are respectively connected through individual relays to a totalizer circuit, the output of said totalizer circuit being connected to activate a temporized alarm circuit, i.e., an alarm circuit that is activated after a time delay during which a continuous activating signal is applied, with a temporization time, or time delay, which is slightly longer than the bridge time of two successive relays thereby detecting sticking thereof.

13. The apparatus as set forth in claim 7, wherein at least one of said N input position switch and M output position switch is equipped with an even number P of relays defining a first group of P/2 relays and a second group of P/2 relays, each of said relays having an input terminal and an output terminal, the input terminals of the relays of the first group and of the second group of P/2 relays being respectively connected two-by-two to the output circuits of P/2 static relays, the inputs of which are connected respectively as P/2 outputs to a "1 among P/2 decoding unit", the input of said decoding unit being connected to the output of a binary counter and to the input of a two-output flip-flop, the output terminals of the first group of P/2 relays being connected together to one of the two outputs of the flip-flop while the output terminals of the second group of P/2 relays are connected together to the other output of the two outputs of the flip-flop, the output of said flip-flop constituting the output of said at least one position switch.

* * * * *